US011078585B2

(12) United States Patent
Pfirrmann et al.

(10) Patent No.: US 11,078,585 B2
(45) Date of Patent: Aug. 3, 2021

(54) METHOD FOR TREATMENT OF A CHROMIUM FINISH SURFACE

(71) Applicant: Atotech Deutschland GmbH, Berlin (DE)

(72) Inventors: Christina Pfirrmann, Berlin (DE); Berkem Özkaya, Berlin (DE); Philipp Wachter, Berlin (DE); Nancy Born, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 357 days.

(21) Appl. No.: 16/323,603

(22) PCT Filed: Sep. 26, 2017

(86) PCT No.: PCT/EP2017/074305
§ 371 (c)(1),
(2) Date: Feb. 6, 2019

(87) PCT Pub. No.: WO2018/060166
PCT Pub. Date: Apr. 5, 2018

(65) Prior Publication Data

US 2019/0203360 A1 Jul. 4, 2019

(30) Foreign Application Priority Data

Sep. 27, 2016 (EP) ..... 16190870

(51) Int. Cl.
*C25D 3/06* (2006.01)
*C25D 5/48* (2006.01)
(Continued)

(52) U.S. Cl.
CPC ..... *C25D 3/06* (2013.01); *C25D 5/48* (2013.01); *C25D 9/08* (2013.01); *C25D 11/38* (2013.01); *C25D 5/14* (2013.01); *C25D 9/06* (2013.01)

(58) Field of Classification Search
CPC ..... C25D 11/38; C25D 5/48; C25D 9/08
See application file for complete search history.

(56) References Cited

U.S. PATENT DOCUMENTS 3,963,528 A 6/1976 Fedrowitz et al.
4,481,040 A 11/1984 Brookes et al.
(Continued)

FOREIGN PATENT DOCUMENTS

DE 102016013792 5/2018
JP 3183797 8/1991
JP 20084959 1/2008

OTHER PUBLICATIONS

PCT/EP2017/074305; PCT International Search Report and Written Opinion of the International Searching Authority dated Dec. 19, 2017.

(Continued)

*Primary Examiner* — Brian W Cohen
(74) *Attorney, Agent, or Firm* — Renner, Otto, Boisselle & Sklar, LLP

(57) ABSTRACT

A method for post-treatment of a chromium finish surface to improve corrosion resistance comprising a) providing a substrate having a chromium finish surface, and at least one intermediate layer between the chromium finish surface and the substrate, selected from the group consisting of nickel, nickel alloys, copper and copper alloys, wherein the chromium finish surface is a surface of a trivalent chromium plated layer, obtained by electroplating the substrate, having the at least one intermediate layer, in a plating bath, the plating bath comprising chromium (III) ions; b) contacting
(Continued)

the chromium finish surface with an aqueous solution, comprising a permanganate, at least one compound which is selected from a phosphorus-oxygen compound, a hydroxide, a nitrate, a borate, boric acid, a silicate, or a mixture of two or more of these compounds; c) forming a transparent corrosion protection layer onto the chromium finish surface during step b.

15 Claims, 4 Drawing Sheets

(51) Int. Cl.

| | |
|---|---|
| ***C25D 9/08*** | (2006.01) |
| ***C25D 11/38*** | (2006.01) |
| ***C25D 9/06*** | (2006.01) |
| ***C25D 5/14*** | (2006.01) |

(56) References Cited

U.S. PATENT DOCUMENTS

| | | | |
|---|---|---|---|
| 4,724,244 | A | 2/1988 | Kempter et al. |
| 9,222,189 | B2 | 12/2015 | Elbick et al. |
| 9,441,306 | B2 | 9/2016 | Pfirrmann et al. |
| 9,650,722 | B2 | 5/2017 | Sugawara et al. |
| 2007/0101571 | A1 | 5/2007 | Kataoka et al. |
| 2012/0052319 | A1 | 3/2012 | Sugawara et al. |
| 2014/0284218 | A1 | 9/2014 | Sugawara et al. |

OTHER PUBLICATIONS

Office Action for corresponding Chinese Application No. 201780052407.0 dated Aug. 13, 2020.

| at.% | As-Plated | Post-treatment | Post-treatment & reduction |
|---|---|---|---|
| C1s | 56.9 | 17.9 | 20.0 |
| O1s | 31.3 | 54.7 | 58.5 |
| N1s | 0.2 | - | 0.9 |
| S2p | 2.4 | 0.4 | 1.5 |
| Na1s | - | <0.1 | 0.3 |
| Cr2p3/2 | 8.7 | 0.4 | 12.0 |
| P2p | - | 10.2 | 6.2 |
| Ca2p | - | 1.0 | 0.3 |
| K2p | - | 3.3 | 0.2 |
| Si2p | 0.6 | - | - |
| Mn2p3/2 | - | 10.8 | - |
| Ni 2p3/2 | - | 1.3 | - |

FIG. 2

METHOD FOR TREATMENT OF A CHROMIUM FINISH SURFACE

The present application is a U.S. National Stage Application based on and claiming benefit and priority under 35 U.S.C. § 371 of International Application No. PCT/EP2017/074305, filed 26 Sep. 2017, which in turn claims benefit of and priority to European Application No. 16190870.2 filed 27 Sep. 2016, the entirety of both of which is hereby incorporated herein by reference.

FIELD OF THE INVENTION

The present invention relates to a method for post-treatment of a chromium finish surface to improve corrosion resistance wherein a chromium finish surface is treated with an aqueous solution and to the use of said aqueous solution for improving corrosion resistance and/or passivation of a chromium finish surface.

BACKGROUND OF THE INVENTION

Chromium surfaces are used in various applications such as a decorative metal finish for substrates like plastic parts in automotive and sanitary industries or as wear resistant coatings for plated parts such as shock absorbers. The chromium surface is usually the outer surface of the substrate and obtained by electroplating a chromium layer from plating bath compositions comprising either Cr(III) ions, Cr(VI) ions or both.

The resulting decorative chromium surface is usually very shiny and fulfils aesthetic requirements. Nevertheless the decorative chromium surface of the chromium layer also provides corrosion protection to the substrate and to additional underlying layers onto the substrate, respectively. However, in some applications of chromium surfaces such as in the automotive and sanitary industry, the corrosion protection provided by a chromium layer which is deposited from a Cr(III) based electrolyte is not sufficient, e.g. in case when 480 h ISO 9227 NSS test without change of appearance of the chromium surface is required. This requirement can at the moment only be fulfilled by plating out of Cr(VI)-based electrolytes or by application of post-treatment methods with solutions comprising toxic Cr(VI) ions.

At least one other metal or metal alloy layer is located between said chromium layer and the substrate. The at least one metal or metal alloy layer is selected from one or more of nickel layer, nickel alloy layer, copper layer and copper alloy layer.

The chromium layer usually comprises micro-cracks after plating or (thermal) annealing, or pores created e.g. by an underlying micro-porous nickel layer. Hence, also the layer material(s) between the chromium layer and the substrate are exposed to the environment. Accordingly, the undesired corrosion of substrates having a chromium layer as the outer surface is caused by the corrosion of the underlying layers. The chromium oxide layer formed on the outer surface of the chromium layer protects said outer surface of the chromium layer from corrosion but not the underlying layer(s). Such multilayer assemblies comprising a chromium layer as the outermost layer are for example disclosed in US 2012/0052319 A1.

Different methods to increase the resistance to corrosion of chromium surfaces and the underlying metal and/or metal alloy layer(s) are known in the art.

Coating agents comprising polymers which contain 0.05 to 3 wt.-% sulfonate and/or phosphonate groups or their respective esters applied for cathodic electrocoating of electrically conductive substrates are disclosed in U.S. Pat. No. 4,724,244. Said polymer is deposited onto the electrically conductive substrate and thereby forms a corrosion protection layer having a thickness of several μm such as 18 μm. The resistance of corrosion is increased by said treatment but the optical appearance of a chromium surface and the surface feel is drastically changed by the thick polymer layer which is not acceptable for e.g. decorative applications of the chromium surface. Furthermore, this method requires a thermal curing of the as deposited polymer which is, due to the necessary high curing temperatures, not applicable to plastic substrates common in automotive industries.

An anodic treatment of metal surfaces with an aqueous solution comprising a compound having hydrophobic carbon-chains with hydrophilic anionic functional groups is disclosed in EP 2 186 928 A1. The resistance to corrosion can be increased by said method but residues creating a foggy appearance remain on the metal surface even after rinsing with water, especially on dark chromium surfaces. Hence, said method is not suitable to increase the resistance to corrosion of a chromium surface and maintain the optical properties of said chromium surface, i.e. the shiny and decorative optical appearance.

EP 2 826 890 A1 concerns a method for cathodic corrosion protection of a substrate having a chromium surface and at least one intermediate layer between the substrate and the chromium surface, selected from the group comprising nickel, nickel alloys, copper and copper alloys and wherein said chromium surface is contacted with an aqueous solution comprising at least one phosphonate compound while passing an electrical current through said substrate, at least one anode and the aqueous solution wherein said substrate serves as the cathode.

OBJECTIVE OF THE INVENTION

It is the objective of the present invention to provide a method for corrosion protection of a substrate having a chromium surface which maintains the optical appearance of the chromium surface.

SUMMARY OF THE INVENTION

The present invention relates to the application of permanganate-based formulations as post treatment for chromium finish surface to improve corrosion resistance, in a wet chemical method.

This objective is solved by a method for post-treatment of a chromium finish surface to improve corrosion resistance, comprising a) providing a substrate having a chromium finish surface, and at least one intermediate layer between the chromium finish surface and the substrate, selected from the group consisting of nickel, nickel alloys, copper and copper alloys, wherein the chromium finish surface is a surface of a trivalent chromium plated layer, obtained by electroplating the substrate, having the at least one intermediate layer, in a plating bath, the plating bath comprising chromium (III) ions as a main chromium source;

b) contacting the chromium finish surface with an aqueous solution, comprising
   - a permanganate,
   - at least one compound which is selected from a phosphorus-oxygen compound, a hydroxide, a nitrate, a borate, boric acid, a silicate, or a mixture of two or more of these compounds;

c) forming a transparent corrosion protection layer onto the chromium finish surface during contacting the chromium finish surface with the aqueous solution in step b).

The increased resistance of corrosion may be shown by a neutral salt spray test according to ISO 922 7 NSS. The achieved corrosion resistance shown by the NSS is at least 120 h without any alteration of the appearance of the surface (area of defects: 0%). The method in particular is used for chromium finish surfaces on substrate in application for the automotive, white goods and sanitary industry, for such as visible decorative chromium finish surfaces on automotive exterior (outside the passenger cabin) parts as bumpers, decorative strips, writing of brand names, etc.; on white goods, as refrigerators, microwaves devices, washing machines, etc.; automotive interior (within the passenger cabin) parts as decorative strips, control buttons etc. and on sanitary parts as shower heads, water-taps, etc.

Furthermore, by the method of the invention the appearance preferably a desired shiny appearance and the color of the chromium finish surface are maintained after post-treatment.

The term "chromium finish surface(s)" or "chromium surface(s)" (used herein equally) in the context of the invention means that the chromium finish surface of the chromium layer is visible to the naked eye of a human being (visible inspection) and is the last metal layer onto the substrate. This last metal layer is only covered by the transparent corrosion protection layer formed in step b) and an optionally transparent organic coating. In other words no further metal layer will be applied onto the chromium finish surface or the corrosion protection layer.

The terms "trivalent chromium plated layer" and "chromium layer" are used equally. "trivalent chromium plated layer" stands for a chromium layer which is plated from a chromium bath comprising chromium (III) ions as a main chromium source. The chromium layer is limited in its dimension by the "chromium finish surface(s)" or "chromium surface(s)" as mentioned before.

The term "transparent" in the context of the invention means that the desired appearance, preferred shiny appearance, and the color of the chromium finish surface is not significantly altered after post-treatment. With other words, the color difference ΔE e.g. (LAB-colorspace, $\Delta E^*_{ab}=\sqrt{(L^*_2-L^*_1)^2+((a^*_2-a^*_1)^2+(b^*_2-b^*_1)^2}$EN ISO 11664-4) of the treated and the untreated surface is <2 and therefore hardly detectable by the naked eye. These results in particular can be found for bright chromium finish surfaces with or without further treatment steps after forming the transparent corrosion protection layer. In case of dark chromium layers further treatment steps after forming the transparent corrosion protection layer may favorable as explained below.

The invention is, in a further aspect, directed to the use of an aqueous solution, comprising:

a permanganate at least one compound which is selected from a phosphorus-oxygen compound, a hydroxide, a nitrate, a borate, boric acid, a silicate, or a mixture of two or more of these compounds, for treating a chromium finish surface in order to form a transparent corrosion protection layer onto the chromium finish surface, particularly for improving corrosion resistance and/or for passivation of the chromium surface. The aqueous solution is preferably used on the chromium finish surface as a decorative chromium finish surface on substrates in application for substrates in the automotive, white goods and sanitary industry.

In one embodiment after using the aqueous solution, the treated chromium finish surface having the transparent corrosion protection layer does not show any alteration of the surface (area of defects: 0%) after applying a NSS test (ISO 922 7) for at least 120 h.

DETAILED DESCRIPTION OF THE INVENTION

The substrate may, as non-limiting examples, be an article made of plastic e.g. ABS, ABS/PC, PA, PI, PP, also called a plastic part, an article made of metal, or an article made of a ceramic. In order to create a substrate having a chromium surface and at least one intermediate layer between the substrate and the chromium surface, selected from the group consisting of nickel, nickel alloys, copper and copper alloys, first said intermediate layer may be deposited on a surface of a substrate (for example a plastic surface), followed by deposition of a chromium layer, in order to create the chromium surface.

At least one intermediate layer(s) selected from the group consisting of nickel, nickel alloys, copper and copper alloys, is located between the substrate and the chromium layer whose surface is exposed. The intermediate layer is located between an inner part of the substrate and the chromium layer. The so-called inner part of the substrate is the bulk part of the substrate, for example a plastic part, and constitutes the bulk volume of the substrate.

In one embodiment an ABS substrate may be used having a multilayer structure of intermediate layer with the order copper, semi-bright nickel, bright nickel (optional non-conductive particle containing nickel ('microporous Nickel')) and a final chromium layer.

In a specific embodiment, the chromium surface is a surface of a trivalent chromium plated layer, obtained by electroplating a substrate comprising the intermediate layer, in a plating bath, the plating bath comprising chromium (III) ions as a main chromium source, wherein the plating bath is substantially free of chromium (VI) ions, which means a chromium (VI) ion content of <0.02 percent by weight. Preferably, no chromium (VI) ions are added to the plating bath.

Formation of a trivalent chromium plated layer and their compositions are known from the state of the art, for example described in EP 2201161 A2.

In a preferred embodiment of the method, the plating bath is substantially free of chromium (VI) ions and the trivalent chromium plated layer, comprises chromium in an amount of 45-90 at % (atom percent), oxygen in an amount of 5-20 at % with the proviso that the total amount of all chemical elements together will not exceed 100 at % and the chromium amount has in every case the highest amount within the trivalent chromium plated layer.

In a more preferred embodiment of the method, the plating bath is substantially free of chromium (VI) ions and the trivalent chromium plated layer, comprises chromium in an amount of 45-90 at %, oxygen in an amount of 5-20 at %, iron in an amount of 0-30 at %, preferably 5-30 at %, carbon in an amount of 0-15 at %, preferably 5-15 at %, sulfur in an amount of 0-15 at %, preferably 1-10 at % and further metals or nonmetals in an amount of 0-1 at %; with the proviso that the total amount of all chemical elements together will not exceed 100 at % and the chromium amount has in every case the highest amount within the trivalent chromium plated layer.

In another preferred embodiment of the method the plating bath is substantially free of chromium (VI) ions and the trivalent chromium plated layer, consists of chromium in an amount of 80-85 at %, oxygen in an amount of 5-15 at %, carbon in an amount of 5-10 at %, sulfur in an amount of 0.5-2 at %; with the proviso that the total amount of all chemical elements together will not exceed 100 at % within the trivalent chromium plated layer.

In still another preferred embodiment of the method the plating bath is substantially free of chromium (VI) ions and the trivalent chromium plated layer, consists of chromium in an amount of 45-80 at %, oxygen in an amount of 5-20 at %, iron in an amount of 1-30 at %, carbon in an amount of 5-20 at %, sulfur in an amount of 0-10 at %; with the proviso that the total amount of all chemical elements together will not exceed 100 at % within the trivalent chromium plated layer.

The trivalent chromium plated layers made by the forenamed preferred embodiment of the method the plating bath, are preferably used for chromium finish surfaces on substrate in application for automotive exterior parts for such as visible decorative chromium finish surfaces.

The chromium layer has preferably a thickness of 0.1-0.6 μm.

The at least one intermediate layer is used to obtain a smooth and shiny chromium surface because the chromium layer itself is very thin and cannot level the roughness imposed by the surface of the substrate.

The chromium layer usually comprises cracks, preferably micro-cracks which can be created during electroplating or after (thermal) annealing. The underlying at least one intermediate layer, which is directly in contact with the trivalent chromium plated layer, is a nickel layer, a nickel alloy layer, a copper layer or a copper alloy layer formed by an electroplating bath comprising Ni or Cu ions. Preferred intermediate layers which are directly in contact with the trivalent chromium plated layer are bright or satin nickel layer, which may function as sacrificial layer over the chromium layer.

Another chromium layer according to the invention preferably contains no cracks and also no pores.

This chromium layer having cracks or no cracks is preferably used for chromium finish surfaces on substrate in application for the white goods, automotive parts within the passenger cabin, and sanitary industry, for such as visible decorative chromium finish surfaces.

Another type of chromium layers having a certain porosity, e.g. micro-porosity, is formed by electroplating the chromium layer on top of a nickel or nickel alloy layer or a nickel or nickel alloy—composite layer (so-called microporous Nickel 'MPS nickel' layer) which comprises small particles of a non-conductive substance such as silicon dioxide and/or aluminum oxide. These chromium layers having pores are preferably used for chromium finish surfaces on substrate in application for automotive parts outside the passenger cabin for such as visible decorative chromium finish surfaces.

Preferably one intermediate layer of the at least one intermediate layer, which is directly in contact with the trivalent chromium plated layer having pores, is a nickel layer such as bright, satin or matt nickel layer, obtained by electroplating the substrate with a nickel electroplating bath comprising e.g. brighteners; or a MPS nickel layer, obtained by electroplating the substrate with a nickel electroplating bath comprising small particles of a non-conductive substance such as silicon dioxide and/or aluminum oxide. The substrate has at least one further intermediate layer which is in case of bright nickel not a bright nickel layer; or in case of MPS nickel layer not a MPS nickel layer.

The number of pores in the trivalent chromium plated layer derived from the directly contacted, underlying bright or satin nickel layer is about 100 pores/$cm^2$ or more, preferably 100-2,000 pores/$cm^2$. The number of pores in the trivalent chromium plated layer derived from the directly contacted, underlying MPS nickel layer is about 10,000 pores/$cm^2$ or more, preferably more than 20,000 pores/$cm^2$, even more preferred 20,000-500,000 pores/$cm^2$. The average diameter of the active pores is about 2 μm. The number of pores can be determined by known tests e.g. Dupernell Test, Cass Test or Pore Count Test (not yet published DE 102016013792.4). In some cases the chromium surface layer comprises pores and cracks (preferably micro-cracks) of about 500-5000/cm.

The bright nickel layer has preferably a thickness of 2-20 μm. The MPS nickel has preferably a thickness of 0.5-3.5 μm.

In all those cases, the chromium layer is not hermetically sealing the underlying intermediate metal and/or metal alloy layer(s). Accordingly, at least the most outer intermediate layer which is in direct contact with the chromium layer is also exposed to the environment and corrosive media. The contact may occur through the pores, mentioned above.

The concentration of the permanganate (i.e. permanganate ion $MnO_4^-$) in the aqueous solution (hereinafter also "the solution") preferably ranges from 0.05-4.5 mol/L, more preferably from 0.1-0.5 mol/L. Suitable permanganates are, without limitation, sodium permanganate, potassium permanganate, or ammonium permanganate.

A phosphorus-oxygen compound may be an inorganic phosphorus-oxygen compound or an organic phosphorus-oxygen compound.

A preferable inorganic phosphorus-oxygen compound is an oxoacid of phosphorous, or a salt thereof. Specifically, the inorganic phosphorus-oxygen compound may be selected from a phosphate, a hydrogenphosphate, a dihydrogenphosphate, a pyrophosphate, a phosphonate (i.e. a salt of phosphorous acid), or an acid form thereof. Mixtures of one or more of these compounds are also comprised by the present invention.

An organic phosphorus-oxygen compound means a phosphorus-oxygen compound comprising at least one hydrocarbon residue. A preferable organic phosphorus-oxygen compound is an oxoacid of phosphorous comprising at least one hydrocarbon residue, or a salt thereof. Specifically, the organic phosphorus-oxygen compound may be selected from an organic phosphonate ($R—PO(OH)_2$, R=hydrocarbon residue), an ester of phosphoric acid, an ester of phosphonic acid (also phosphorous acid), a phosphite ester, or a salt thereof. Mixtures of one or more of these compounds are also comprised by the present invention.

The concentration of the at least one compound which is selected from phosphorus-oxygen compound, a hydroxide, a nitrate, a borate, boric acid, a silicate, or a mixture of two or more of these compounds, preferably ranges from 0.05-2 mol/L, more preferably from 0.2-0.6 mol/L. This concentration relates to the total concentration of all these compounds, if more than one is present. If the compound is an ionic compound, this concentration relates to the anion, or the anion in a mentioned compound, as for example $PO_4^{3-}$, $H_2PO_4^-$, $R_1PO(OR_2)O^-$ (where $R_1$=alkyl, aryl, $R_2$=H, alkyl, aryl), $NO_3^-$, $OH^-$, $B_4O_7^{2-}$. The compound may be added as a buffer, particularly $KH_2PO_4$, $Na_2B_4O_7$, as an acid, such as $HNO_3$, or as a base or brine, such as NaOH. If more than one of these compounds is used, the concentration indicates the total concentration of all these compounds. More than one phosphorus-oxygen compound may be present (i.e. two or more thereof) in dependency of the pH of the solution, for example a salt and an acid form may be present simultaneously, such as ((di)hydrogen)phosphate and phosphorous acid. Borate may be present as mono-, di-, tri- and/or tetraborate. Suitable cations for mentioned compounds, if it is not an acid, are sodium, potassium and ammonium without limitation.

In one embodiment, the pH value of the aqueous solution ranges from 1 to 7, particularly when $H_3PO_4/HPO_4^-$, or $H_2PO_4^-/HPO_4^{2-}$ are used.

In another embodiment, the pH value of the aqueous solution ranges from 7 to 11, particularly when $OH^-$ is used.

In another embodiment, the pH value of the aqueous solution ranges from 1 to 5, particularly when $HNO_3$ is used.

The transparent corrosion protection layer formed onto the chromium finish surface during contacting the chromium finish surface with the aqueous solution in step b) has a thickness of about 1-50 nm, preferably 5-10 nm. Without wishing to be bound by theory it is believed that chromium (III) oxides are likely formed by the chromium of the chromium layer by permanganate treatment and therefore the transparent corrosion protection layer comprises as main component chromium(III) oxide ($Cr_2O_3$).

The substrate comprising the chromium finish surface may be brought into contact with the aqueous solution by dipping said substrate into said aqueous solution, by spraying said aqueous solution onto said substrate or by brushing said aqueous solution onto said substrate. The contacting time for contacting the chromium finish surface with an aqueous solution is between 5-900 seconds, preferably 10-400 seconds, preferably in case of dipping 5-900 seconds.

The method of the invention may be performed electroless or with application of electrical current. In one embodiment, in step b) of the method an electric potential is applied between the chromium surface, which serves as an anode or a cathode, and an inert counter electrode, preferably the chromium surface serves as a cathode and the counter electrode as an anode. The inert counter electrode can be for example made of a material selected from the group comprising stainless steel, graphite, mixed oxide coated titanium or platinized titanium.

When applying an electric potential, an electric current is passed through the substrate comprising the chromium surface. Preferably the chromium surface serves as a cathode.

By using additionally an application of electrical current the corrosion resistance can be improved, wherein the achieved corrosion resistance shown by the NSS is more 120 h, preferably at least 120 h-240 h, more preferred at least 120 h-480 h without any alteration of the surface (area of defects: 0%). Without binding by theory it is believed that the underlying metal layer, preferably a bright nickel layer, satin Ni layer or a MPS nickel layer, which is directly in contact with the trivalent chromium plated layer, is also affected, forming at least partly a passivation layer adjacent to the cracks or pores and cracks of the chromium layer. This way, corrosion half reactions 1) oxygen reduction reaction (on chromium surface, the cathode) and 2) nickel dissolution (on underlying nickel surface exposed through the pores or cracks, the anode) suppressed, leading to an improved corrosion resistance.

A current density of 0.005-5 $A/dm^2$, related to the area of the chromium surface serving as cathode, may be generated, preferably 0.02-1.5 $A/dm^2$.

In case the chromium surface serves as an anode it is preferred that a current density of less than 0.5 $A/dm^2$, preferably of 0.005-0.5 $A/dm^2$.

If an electrolytic process is used, the contacting time between article and solution may be in the same range as the electroless process In case the chromium surface serves as an cathode an electric potential, or a current, may be applied for 5-900 seconds, preferably 10-400 seconds.

In case the chromium surface serves as an anode an electric potential, or a current, may be applied for less than 100 seconds, preferably less than 60 seconds, most preferably of 5-60 seconds.

Contacting the chromium surface with the aqueous solution may be done at a temperature of the solution of 20-100° C., preferably 25-50° C.

The substrate comprising the chromium surface may be brought into contact with the aqueous solution during the electrolytic process by dipping said substrate into said aqueous solution, by spraying said aqueous solution onto said substrate or by brushing said aqueous solution onto said substrate, preferably by dipping.

After step c) the treated chromium surface having the transparent corrosion protection layer a water rinsing step may be applied, preferably with DI-water in order to rinse the aqueous solution.

During treatment with permanganate, $MnO_2$ may be formed onto the transparent corrosion protection layer. Preferably the formed transparent corrosion protection layer is substantially free of $MnO_2$ after step c).

"Substantially free of $MnO_2$" means that the amount of $MnO_2$ onto the surface of the transparent corrosion protection layer or parts of said surface is such less that no apparent color change of the chromium finish surface, in particular of bright chromium finish surface is observed by the naked eye of a human being (visible inspection).

In some cases e.g. dark chromium surfaces, the formed transparent corrosion protection layer may comprise $MnO_2$ which are detectable by visual inspection.

Therefore in one embodiment, the method of the invention comprises, as a further step:

d) treating the chromium surface, after treatment with the aqueous solution in step b), with a component able to reduce and/or dissolve $MnO_2$, particularly with an acid and/or reducing agent.

By the treatment with said component, particularly with a reducing agent, the appearance and the color of the chromium finish surface, after treatment with permanganate, can be improved or re-establish, wherein the transparent corrosion protection layer is not altered and will achieve corrosion resistance after 120 h NSS.

It has been shown that after the reduction step no apparent color change of the chromium surface is observed. It has been shown that in step d) a layer of $MnO_2$ may be reduced and a phosphorus rich chromium(III) oxide layer can be obtained when a solution comprising a phosphorus-oxygen compound was used in step b). It has been turned out that such phosphorus rich layer has beneficial passivation properties. Without wishing to be bound by theory it is believed that chromium(III) oxides are likely formed by permanganate treatment. However, it has been shown that by the present method, after steps b) and d), an oxide layer is formed whose oxide thickness is higher compared to the non-modified surface (i.e. surface without treatment according to steps b) and d)).

The component, particularly a reducing agent, may be hydrogen peroxide, hydrazine, potassium iodide, sodium sulfite, hydroxylammonium sulfate or carbohydrates, preferably a reducing carbohydrate, more preferably reducing sugars and even more preferably monosaccharides like glucose.

The acid may be selected from e.g. sulfuric acid, nitric acid, ascorbic acid and acetic acid.

Acid and/or reducing agent are preferably applied in solution.

The temperature of treatment with the component, such as acid and/or reducing agent, may be 25-45° C. The application time is preferably 10-600 seconds.

In one embodiment, the method according of the invention comprises, as a further step: rinsing the chromium surface after treatment with the aqueous solution in step b), and before treatment with the component in step d).

The aqueous solution may comprise a conducting salt and/or a surfactant.

BRIEF DESCRIPTION OF THE FIGURES

FIG. 2 indicates the elemental surface composition of as-plated chromium surface, chromium surface after post-treatment and chromium surface after post-treatment and reduction step according to Example 6.

EXAMPLES

Figure 1:
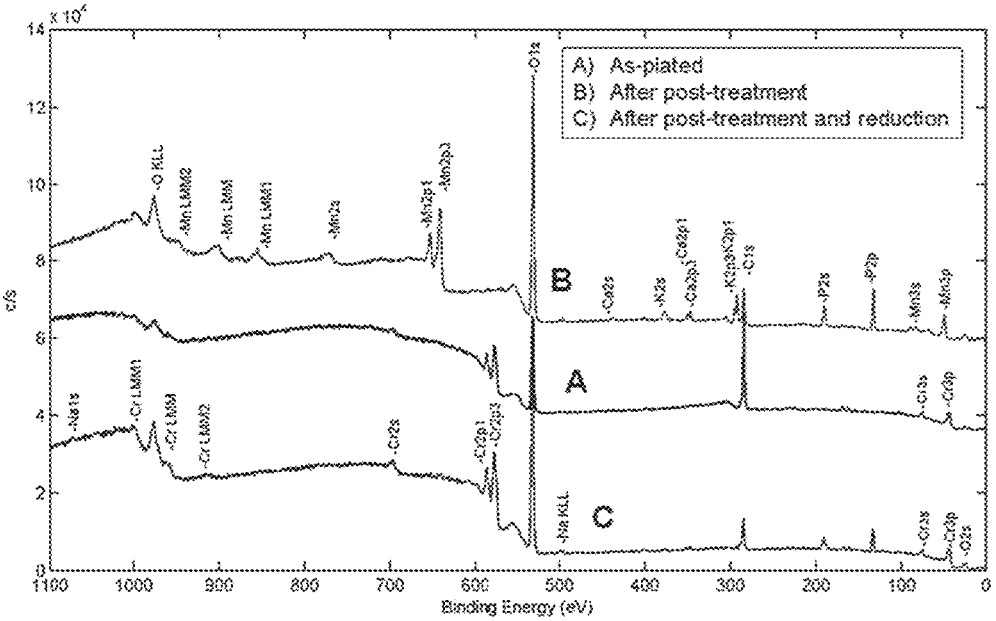
FIG. 1 demonstrates the results of XPS analyses performed on as-plated chromium surface, chromium surface after post treatment and chromium surface after post-treatment and reduction step according to Example 6.
Figure 3:
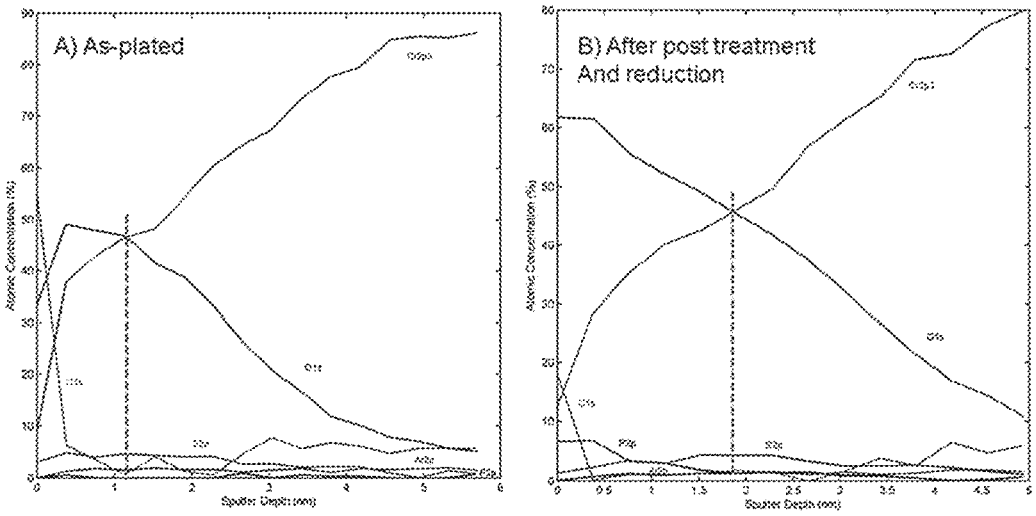
FIG. 3 is a view showing the depth profiles of as-plated and post-treated and reduced surface acquired by means of XPS sputter profiling. Dashed line shows the cross-over point of Cr and O concentration, which can be taken as a qualitative indicator of oxide film thickness according to Example 6.
Figure 4:
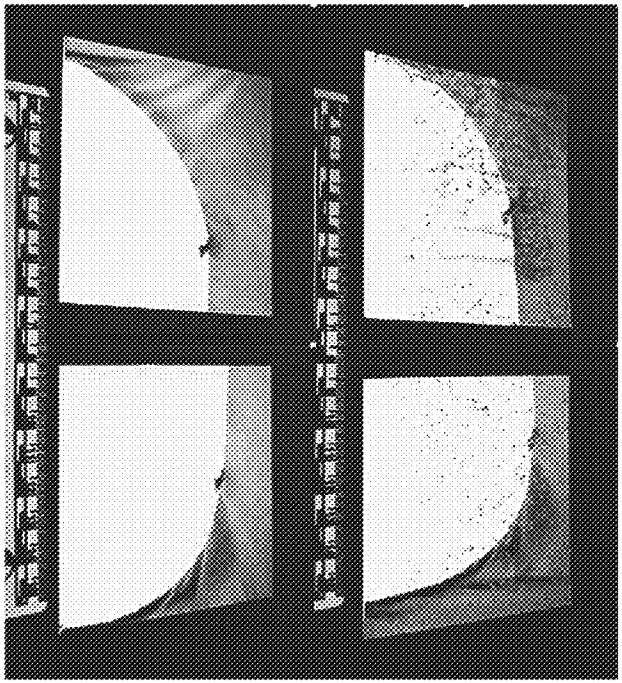
FIG. 4 shows the panels after 480 h neutral salt spray test according to ISO 9227. Upper panels show the chromium surface without post treatment with visible corrosion products on the surface and lower panels demonstrate the post treated surfaces according to Example 1 (without post-treatment and according to Example 2 (with post-treatment).

The invention will now be illustrated by reference to the following non-limiting examples.

ABS substrates of the same size which comprise a multilayer of copper, semi-bright nickel, bright nickel, optional non-conductive particle containing nickel ('microporous Nickel') and a final chromium layer as well as brass panels (10×10 mm) which comprise a layer of bright nickel and a final chromium layer were used for the examples. The chromium layer was either a bright chromium layer or a dark chromium layer as indicated in the respective example which has been deposited from a trivalent chromium based electrolyte.

The optical appearance of the chromium surface was visually inspected prior to the neutral salt spray tests.

Neutral salt spray (NSS) tests were performed according to ISO 9227. The results are given with the respective examples.

Example 1

Comparative

A bright chromium surface (brass panel) was investigated without any post-treatment by a neutral salt spray test according to ISO 9227 NSS.

The untreated bright chromium surface possess a significant change of appearance when visually inspected after 120 h of the chromium surface (area of defects >5-10%).

Example 2

A bright chromium surface (brass panel) was treated with an aqueous solution comprising 40 g/L potassium permanganate ($KMnO_4$) and 50 g/L monopotassium dihydrogenphosphate ($KH_2PO_4$) for 90 seconds at 25° C. while applying a current density of 1 A/dm$^2$ to the chromium surface as the cathode. Afterwards the chromium surface was rinsed with DI-water and dipped into a solution consisting of $H_2SO_4$ and $H_2O_2$ for 5 seconds at 25° C.

The optical appearance was not significantly changed after the post-treatment and the treated chromium surface passed the corrosion test when visually inspected after 480 h neutral salt spray test without any alteration (area of defects: 0%).

Example 3

Comparative

A bright chromium surface (ABS cap with non-conductive particle containing nickel within the multilayer) was investigated without any post-treatment by a neutral salt spray test according to ISO 9227 NSS.

The untreated bright chromium surface possess when visually inspected after 120 h a significant change of appearance of the chromium surface (area of defects >10-25%).

Example 4

A bright chromium surface (ABS cap without non-conductive particle containing nickel within the multilayer) was treated with an aqueous solution comprising 40 g/L potassium permanganate ($KMnO_4$) and 50 g/L monopotassium dihydrogenphosphate ($KH_2PO_4$) for 90 seconds at 25° C. while applying a current density of 1 A/dm$^2$ to the chromium surface as the cathode. Afterwards the chromium surface was rinsed with DI-water and dipped into a solution consisting of $H_2SO_4$ and $H_2O_2$ for 5 seconds at 25° C.

The optical appearance was not significantly changed after the post-treatment and the treated chromium surface passed the corrosion test when visually inspected after 480 h neutral salt spray test without any alteration (area of defects: 0%).

Example 5

A bright chromium surface (ABS cap with non-conductive particle containing nickel within the multilayer) was treated with an aqueous solution comprising 40 g/L sodium permanganate ($NaMnO_4$) and 50 g/L monopotassium dihydrogenphosphate ($KH_2PO_4$) for 10 minutes at 50° C. without applying an external current to said chromium surface.

The optical appearance was not significantly changed after the post-treatment and the treated chromium surface passed the corrosion test when visually inspected after 120 h neutral salt spray test without any alteration (area of defects: 0%).

Example 6

A bright chromium surface (ABS cap with non-conductive particle containing nickel within the multilayer) was treated with an aqueous solution comprising 40 g/L sodium permanganate ($NaMnO_4$) and 50 g/L monopotassium dihydrogenphosphate ($KH_2PO_4$) for 60 seconds at 25° C. while applying a current density of 0.5 A/dm$^2$ to the chromium surface as the cathode. Afterwards the chromium surface was rinsed with DI-water and dipped into a solution consisting of $H_2SO_4$ and $H_2O_2$ for 5 seconds at 25° C.

The optical appearance was not significantly changed after the post-treatment and the treated chromium surface passed the corrosion test when visually inspected after 120 h neutral salt spray test without any alteration (area of defects: 0%). Even after 480 h neutral salt spray test the chromium surface exhibit of only slight changes of the chromium surface (area of defects <0.5%).

Example 7

A bright chromium surface (ABS cap with non-conductive particle containing nickel within the multilayer) was treated with an aqueous solution comprising 40 g/L potassium permanganate ($KMnO_4$) and 50 g/L monopotassium dihydrogenphosphate ($KH_2PO_4$) for 3 minutes at 25° C. while applying a current density of 0.5 A/dm$^2$ to the chromium surface as the cathode. Afterwards the chromium surface was rinsed with DI-water and dipped into a solution consisting of $H_2SO_4$ and $H_2O_2$ for 5 seconds at 25° C.

The optical appearance was not significantly changed after the post-treatment and the treated chromium surface passed the corrosion test when visually inspected after 480 h neutral salt spray test without any alteration (area of defects: 0%).

Example 8

A bright chromium surface (ABS cap with non-conductive particle containing nickel within the multilayer) was treated with an aqueous solution comprising 40 g/L sodium permanganate ($NaMnO_4$) and 50 mL/L sodium hydroxide solution (NaOH, 30 ww %) for 30 seconds at 50° C. while applying a current density of 0.5 A/dm$^2$ to the chromium surface as the cathode. Afterwards the chromium surface was rinsed with DI-water and dipped into a solution consisting of $H_2SO_4$ and $H_2O_2$ for 5 seconds at 25° C.

The optical appearance was not significantly changed after the post-treatment and the treated chromium surface passed the corrosion test when visually inspected after 120 h neutral salt spray test without any alteration (area of defects: 0%).

Example 9

A bright chromium surface (ABS cap with non-conductive particle containing nickel within the multilayer) was treated with an aqueous solution comprising 40 g/L sodium permanganate ($NaMnO_4$) and 15 g/L sodium tetraborate ($Na_2B_4O_7 \cdot 10H_2O$) 10 minutes at 50° C. without applying an external current to said chromium surface. Afterwards the chromium surface was rinsed with DI water and dipped into a solution consisting of $H_2SO_4$ and $H_2O_2$ for 5 seconds at 25° C.

The optical appearance was not significantly changed after the post-treatment and the treated chromium surface shows an enhancement of the corrosion resistance compared to the untreated: When visually inspected after 120 h neutral salt spray test the treated chromium surface exhibits only of slight changes of the chromium surface (area of defects <0.25%).

Example 10

Comparative

A dark chromium surface (ABS cap with non-conductive particle containing nickel within the multilayer) was investigated without any post-treatment by a neutral salt spray test according to ISO 9227 NSS.

The untreated bright chromium surface possesses when visually inspected after 120 h a significant change of appearance of the chromium surface (area of defects >50%).

Example 11

A dark chromium surface (ABS cap without non-conductive particle containing nickel within the multilayer) was treated with an aqueous solution comprising 40 g/L potassium permanganate ($KMnO_4$) and 50 g/L monopotassium dihydrogenphosphate ($KH_2PO_4$) for 90 seconds at 25° C. while applying a current density of 1 A/dm$^2$ to the chromium surface as the cathode. Afterwards the chromium surface was rinsed with DI water and dipped into a solution consisting of $H_2SO_4$ and $H_2O_2$ for 5 seconds at 25° C.

The optical appearance was not significantly changed after the post-treatment and the treated chromium surface passed the corrosion test when visually inspected after 120 h neutral salt spray test without any alteration (area of defects: 0%). Even after 480 h neutral salt spray test the chromium surface exhibit of only slight changes of the chromium surface (area of defects <0.25%).

Example 12

A dark chromium surface (brass panel) was treated with an aqueous solution comprising 40 g/L potassium permanganate ($KMnO_4$) and 50 g/L monopotassium dihydrogenophosphate ($KH_2PO_4$) for 90 seconds at 25° C. while applying a current density of 1 A/dm$^2$ to the chromium surface as the cathode. Afterwards the chromium surface was rinsed with DI water and dipped into a solution consisting of $H_2SO_4$ and $H_2O_2$ for 5 seconds at 25° C.

The optical appearance was not significantly changed after the post-treatment and the treated chromium surface passed the corrosion test when visually inspected after 120 h neutral salt spray test without any alteration (area of defects: 0%). After 240 h neutral salt spray test the chromium surface exhibit of only slight changes of the chromium surface (area of defects <0.1%).

Example 13

A dark chromium surface (ABS cap with non-conductive particle containing nickel within the multilayer) was treated with an aqueous solution comprising 40 g/L potassium permanganate ($KMnO_4$) and 50 g/L monopotassium dihydrogenophosphate ($KH_2PO_4$) for 10 minutes at 50° C. without applying an external current to said chromium surface.

Afterwards the chromium surface was rinsed with DI water and dipped into a solution consisting of $H_2SO_4$ and $H_2O_2$ for 5 seconds at 25° C.

The optical appearance was not significantly changed after the post-treatment and the treated chromium surface shows an significant enhancement of the corrosion resistance compared to the untreated: When visually inspected after 480 h neutral salt spray test the treated chromium surface exhibits of only slight changes of the chromium surface (area of defects <0.1%).

Example 14

A dark chromium surface (ABS cap with non-conductive particle containing nickel within the multilayer) was treated with an aqueous solution comprising 40 g/L potassium permanganate ($KMnO_4$) and 50 g/L nitric acid ($HNO_3$) for 10 minutes at 50° C. without applying an external current to said chromium surface. Afterwards the chromium surface was rinsed with DI water and dipped into a solution consisting of $H_2SO_4$ and $H_2O_2$ for 5 seconds at 25° C.

The optical appearance was not significantly changed after the post-treatment and the treated chromium surface passed the corrosion test when visually inspected after 120 h neutral salt spray test without any alteration (area of defects: 0%). After 240 h neutral salt spray test the chromium surface exhibit of only slight changes of the chromium surface (area of defects <0.1%).

Example 15

A bright chromium surface (ABS cap with non-conductive particle containing nickel within the multilayer) was treated with an aqueous solution comprising 40 g/L potassium permanganate ($KMnO_4$) and 50 g/L monopotassium dihydrogenophosphate ($KH_2PO_4$) for 90 seconds at 25° C. while applying a current density of 0.1 A/dm$^2$ to the chromium surface as the cathode. Afterwards the chromium surface was rinsed with DI-water.

The optical appearance was not significantly changed after the post-treatment and the treated chromium surface passed the corrosion test when visually inspected after 480 h neutral salt spray test without any alteration of the surface (area of defects: 0%).

Example 16

A bright chromium surface (ABS cap with non-conductive particle containing nickel within the multilayer) was treated with an aqueous solution comprising 40 g/L potassium permanganate ($KMnO_4$) and 50 g/L monopotassium dihydrogenophosphate ($KH_2PO_4$) for 90 seconds at 25° C. while applying a current density of 1.5 A/dm$^2$ to the chromium surface as the cathode. Afterwards the chromium surface was rinsed with DI-water.

The optical appearance was not changed after the post-treatment and the treated chromium surface passed the corrosion test when visually inspected after 480 h neutral salt spray test without any alteration of the surface (area of defects: <0.1%).

Example 17

A bright chromium surface (ABS cap with non-conductive particle containing nickel within the multilayer) was treated with an aqueous solution comprising 40 g/L potassium permanganate ($KMnO_4$) and 50 g/L monopotassium dihydrogenophosphate ($KH_2PO_4$) for 90 seconds at 25° C. while applying a current density of 1.0 A/dm$^2$ to the chromium surface as the cathode. Afterwards the chromium surface was rinsed with DI-water.

The optical appearance was not changed after the post-treatment and the treated chromium surface passed the corrosion test when visually inspected after 480 h neutral salt spray test without any alteration of the surface (area of defects: 0%).

The invention claimed is:

1. A method for post-treatment of a chromium finish surface to improve corrosion resistance, comprising a) providing a substrate having a chromium finish surface, and at least one intermediate layer between the chromium finish surface and the substrate, wherein the at least one intermediate layer is selected from the group consisting of nickel, nickel alloys, copper and copper alloys, wherein the chromium finish surface is a surface of a trivalent chromium plated layer, obtained by electroplating the substrate having the at least one intermediate layer, in a plating bath, the plating bath comprising chromium (III) ions as a main chromium source;

b) contacting the chromium finish surface with an aqueous solution, comprising a permanganate, and at least one compound which is selected from a phosphorus-oxygen compound, a hydroxide, a nitrate, a borate, boric acid, a silicate, or a mixture of two or more of these compounds; and c) forming a transparent corrosion protection layer onto the chromium finish surface during contacting the chromium surface with the aqueous solution in step b, wherein in step b) an electric potential is applied between the chromium finish surface and an inert counter electrode, wherein the chromium finish surface serves as a cathode and the inert counter electrode serves as an anode.

2. The method of claim 1, wherein the at least one compound is selected from inorganic phosphorus-oxygen compound as a phosphate, a hydrogenphosphate, a dihydrogenphospate, a pyrophosphate, a phosphonate or mixtures thereof; hydroxide; a borate or a nitrate.

3. The method according to claim 1, wherein the plating bath is substantially free of chromium (VI) ions and the trivalent chromium plated layer comprises chromium in an amount of 45-90 at % (atom percent), oxygen in an amount of 5-20 at % with the proviso that the total amount of all chemical elements together will not exceed 100 at % and the chromium amount has in every case the highest amount within the trivalent chromium plated layer.

4. The method according to claim 1, wherein the plating bath is substantially free of chromium (VI) ions and the trivalent chromium plated layer comprises chromium in an amount of 45-90 at %, oxygen in an amount of 5-20 at %, iron in an amount of 0-30 at %, carbon in an amount of 0-15 at %, sulfur in an amount of 0-15 at %, and further metals or nonmetals in an amount of 0-1 at %; with the proviso that the total amount of all chemical elements together will not exceed 100 at % and the chromium amount has in every case the highest amount within the trivalent chromium plated layer.

5. The method according to claim 1, wherein one of the at least one intermediate layer, which is directly in contact with the trivalent chromium plated layer, the trivalent chromium plated layer having pores or pores and cracks, is a bright or satin nickel layer, obtained by electroplating the substrate, and further comprises at least one further intermediate layer which is not a bright nickel layer; or is a MPS nickel layer, obtained by electroplating the substrate, and further comprises at least one further intermediate layer which is not a MPS nickel layer.

6. The method of claim 1, wherein a current density of 0.005-5 $A/dm^2$, related to the area of the chromium surface, is generated.

7. The method of claim 1, wherein the electric potential is applied for 5-900 seconds.

8. The method according to claim 1, comprising, as a further step d) treating the chromium surface, after treatment with the aqueous solution in step b), with a component able to reduce and/or dissolve $MnO_2$.

9. The method according to claim 8, wherein the component is hydrogen peroxide, hydrazine, potassium iodide, sodium sulfite, hydroxylammonium sulfate or a carbohydrate.

10. The method according to claim 8, wherein the component is selected from sulfuric acid, nitric acid, ascorbic acid and acetic acid.

11. The method according to claim 8, comprising, as a further step: rinsing the chromium surface after treatment with the aqueous solution in step b), and before treatment with the acid and/or reducing agent in step d).

12. The method according to claim 1, wherein concentration of permanganate in the aqueous solution is 0.05-4.5 mol/L.

13. The method according to claim 1, wherein concentration of the phosphorus-oxygen compound, hydroxide, nitrate, borate, boric acid, or silicate in the aqueous solution is 0.05-2 mol/L.

14. The method according to claim 1, further comprising using the chromium finish surface as a decorative chromium finish surface on a substrate in the automotive, white goods and sanitary industry.

15. The method according to claim 1, further comprising applying a NSS test (ISO 922 7), wherein the treated chromium finish surface having the transparent corrosion protection layer does not show any alteration of the surface (area of defects: 0%) after applying the NSS test (ISO 922 7) for at least 120 h.

* * * * *